US007685919B2

(12) United States Patent
Lantz et al.

(10) Patent No.: US 7,685,919 B2
(45) Date of Patent: Mar. 30, 2010

(54) METHOD OF CONFIGURING WEAPON

(75) Inventors: Eje Lantz, Eskilstuna (SE); Kent Norgren, Karlskoga (SE); Lars Ax, Tullinge (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 11/653,939

(22) Filed: Jan. 17, 2007

(65) Prior Publication Data

US 2010/0031809 A1 Feb. 11, 2010

(30) Foreign Application Priority Data

Jan. 17, 2006 (EP) ..... 06100439

(51) Int. Cl.
*F41A 1/08* (2006.01)

(52) U.S. Cl. ..... 89/1.7; 89/1.1

(58) Field of Classification Search ..... 89/1.7, 89/1.701–1.706, 1.1; 206/315.11, 317
See application file for complete search history.

(56) References Cited

U.S. PATENT DOCUMENTS 1,562,810 A * 11/1925 Towl ..... 81/177.1
4,026,189 A * 5/1977 Akhagen et al. ..... 89/1.703
5,109,750 A * 5/1992 Kayaian ..... 89/1.704
5,162,604 A * 11/1992 Wilson ..... 89/1.7
5,515,767 A * 5/1996 Gilbert ..... 89/1.701
5,551,330 A * 9/1996 Reuche ..... 89/1.701
6,286,408 B1 * 9/2001 Sanford et al. ..... 89/1.701
6,568,330 B1 * 5/2003 Kaiserman et al. ..... 89/1.7
2002/0134693 A1 9/2002 Boutet et al.
2005/0217468 A1 * 10/2005 Ax et al. ..... 89/1.704

FOREIGN PATENT DOCUMENTS

FR 1359534 A 4/1964
FR 1023998 A 3/1966
GB 2129105 A 5/1984
WO WO 2004/109212 A 12/2004

OTHER PUBLICATIONS

European Search Report issued in priority application, May 29, 2006.
European Search Report—Jul. 24, 2008.

* cited by examiner

*Primary Examiner*—Michael Carone
*Assistant Examiner*—Jonathan C Weber
(74) *Attorney, Agent, or Firm*—Venable LLP; Eric J. Franklin

(57) ABSTRACT

A method of configuring a preloaded anti-armour weapon of the disposable type and including a countermass container in transport mode for restraining a shell loaded in a barrel of the weapon. The countermass container is replaced with a locking ring and the loaded barrel is placed in a first compartment and the countermass container is placed in a second compartment of a transport box.

5 Claims, 2 Drawing Sheets

Fig. 1
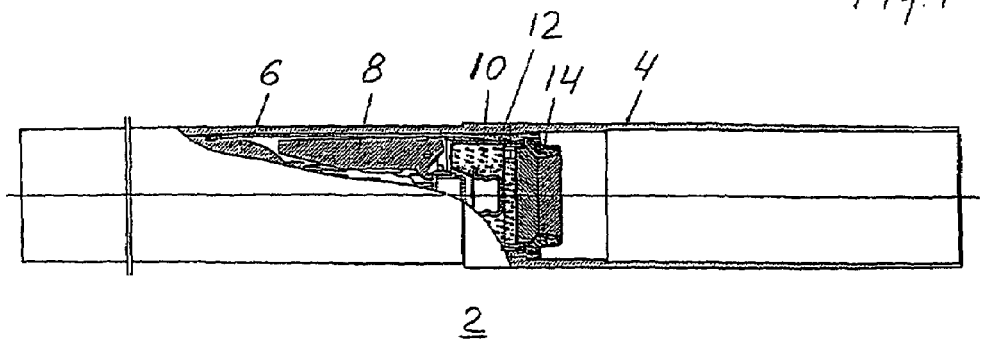
Fig. 2
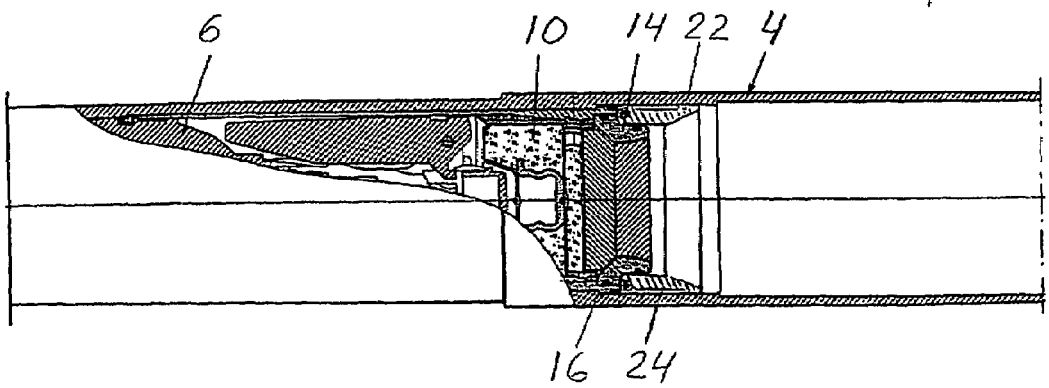
Fig. 3a
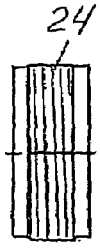
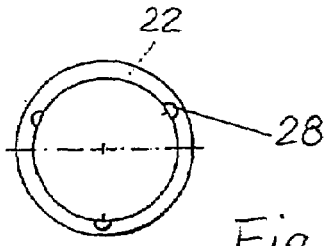
Fig. 3b

Fig. 4a
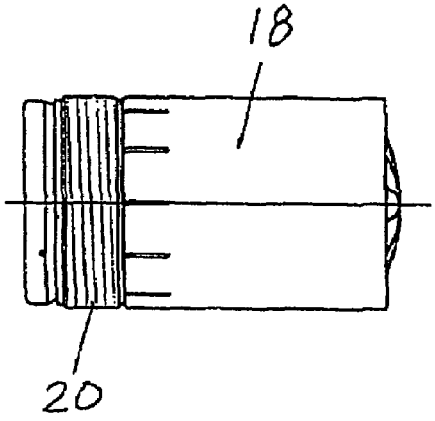
Fig. 4b
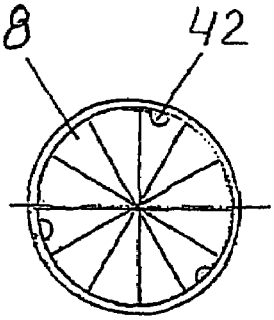
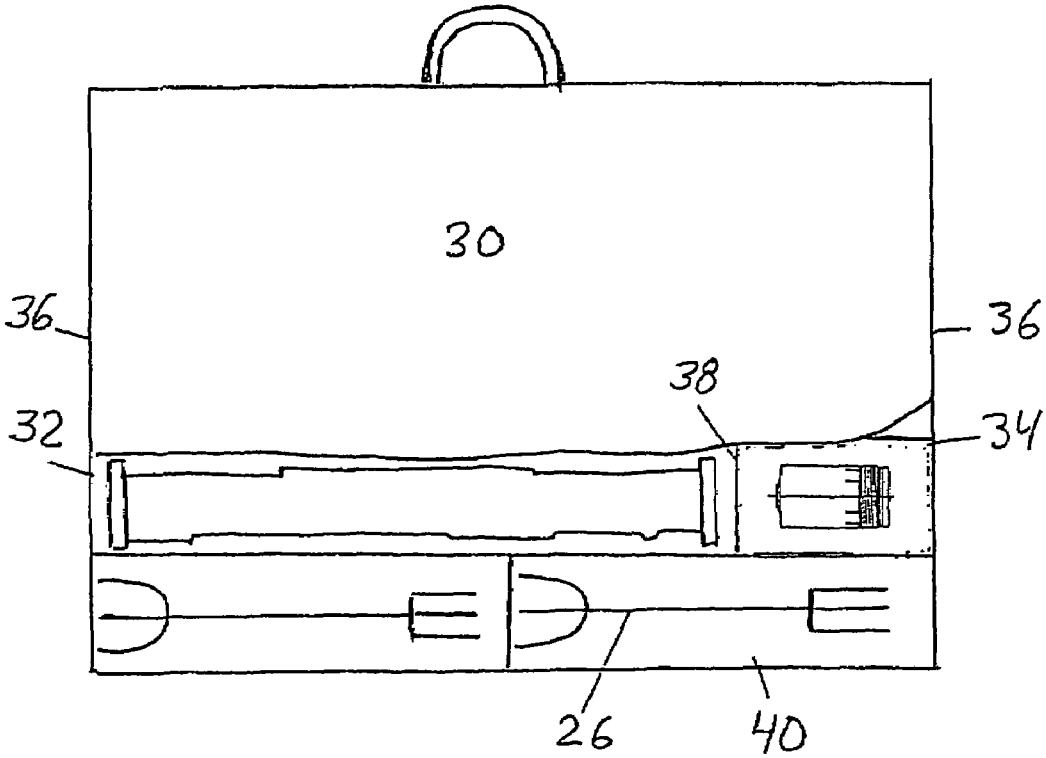
Fig. 5

METHOD OF CONFIGURING WEAPON

CROSS-REFERENCE TO RELATED APPLICATIONS

This application claims priority to European patent application 06100439.6 filed 17 Jan. 2006.

BACKGROUND OF THE INVENTION

1. Technical Field of the Invention

The present invention relates to a method of configuring a weapon comprising a countermass in transport mode for restraining a shell in a barrel of said weapon. More particularly, the invention relates to a shell restraining method which is mainly adapted for transport and storing of a preloaded anti-armour weapon of the disposable type being stored in compartment of a transport box, in order to prevent the shell from exiting the barrel and detonating should the propellant charge of the shell accidentally ignite.

2. Description of Related Art

When transporting and storing preloaded anti-armour weapons of the disposable type there is in some cases, involving Slow Cook Off (SCO), Sympathetic Detonation (SD), Fast Cook Off (FCO), Bullet Impact (BI), and Fragment Impact (FI) situations, a potential chance of an accidental firing of the propellant charge. Further, depending on today's hard requirements on useful munition life, said weapons might be provided with a counter mass container made of titanium. This would involve pressure that is hard to manage in the weapons system and call for a secure solution. Therefore, any accidental firing of the propellant charge would lead to a closely following detonation, if the shell should exit the barrel of the weapon, which in turn would lead to possible fatal consequences. In this connection, reference might be made to our SE patents 0301626-8 and 0301627-6, which each shows an example of a weapon with countermass of the indicated kind. However, up till now the related technical field lacks a suitable solution to the present problem.

SUMMARY OF THE INVENTION

One object of the present invention is to provide a shell restraining method for preventing a shell from exiting the barrel of the weapon should the propellant charge of the shell be accidentally ignited during transportation and storage of the weapon in a compartment box, and thereby preventing an accidental detonation of the shell in the vicinity.

For this purpose a method according to the present invention is characterized by the following steps:

a) configuring the weapon with a round, comprising a shell and a cartridge case assembly with a discharge nozzle, loaded in said barrel and b) configuring the weapon with said countermass located outside the barrel.

One variant of the method according to the invention is characterized by the following steps:

c) placing the barrel in compartment of a transport box, d) placing a countermass container, provided with a first locking means for mounting in the barrel, separate from said compartment.

Another variant of the method according to the invention is characterized by the step of: e) placing said barrel in a first compartment and said countermass container in a second compartment of said transport box.

Further variants, improvements and developments of the method according to the invention appear from the following detailed description and the appended claims with reference to the accompanying schematic drawings. Similar or identical items are identified by the same reference numbers.

BRIEF DESCRIPTION OF THE DRAWINGS

FIG. 1 is a partial length-sectional view of the barrel of a preloaded anti-armour weapon of the disposable type, FIG. 2 is a more detailed disclosure in enlarged scale of FIG. 1 including a locking ring mounted in the barrel, FIGS. 3*a* and 3*b* show said locking ring in more detail, FIGS. 4*a* and 4*b* show different views of an appropriate countermass container and FIG. 5 shows a transport box suitable for transport and storing of said weapon.

DETAILED DESCRIPTION OF THE INVENTION

FIG. 1 illustrates a partial length-sectional view through a preloaded anti-armour weapon 2 of the disposable type configured in transport mode. Said weapon includes a barrel 4 of fiber-reinforced composite material, which might be loaded, for example, with a round comprising a shell 6 including a fin assembly 8 and a propellant and igniter composition 10 housed in a cartridge case 12.

As can be best seen in FIG. 2, a discharge nozzle 14 is mounted in said cartridge case by means of an annular sealing and said cartridge case in turn bear on a collar 16 in said barrel. Normally, a countermass container 18 of a previously known kind, which will be described in more detail later, would be mounted in the barrel 4 by means of a first locking means 20, e.g. a bayonet fitting or a self-locking screw thread, and thereby would bear on a protruding part of said nozzle. Hence, by means of said collar 16 and said countermass container 18, the cartridge case 12 and discharge nozzle 14 would be prevented from axial movements in a launch direction and a counter-launch direction as well.

However, the method according to the present invention prescribes that the weapon 2 be configured in transport mode for restraining said shell 6 in the barrel 4, in order to prevent the shell from exiting the barrel and detonating should the propellant charge of the shell accidentally ignite. This is achieved, in transport mode, in that said counter mass container would not be mounted in the barrel 4, which would result in the cartridge case 12 and nozzle 14 being prevented from displacement axially in the barrel 4 in a launch direction, but allowed to be displaced in a counter-launch direction.

Therefore, according to the invention the weapon is configured in transport mode by introduction of a locking ring 22, which is placed in the barrel 4 and mounted by means of a similar second locking means, for example a bayonet fitting or self-locking screw thread as previously described in connection with the countermass container, and thereby likewise would bear on the protruding part of the nozzle 14. In the disclosed example said second locking means is configured as a self-locking screw thread 24.

In order to facilitate mounting of said locking ring 22 a suitable assembly tool 26 is introduced, which is configured as a bar with a trident in each end, a first trident and a second trident of a double grip assembly tool 26. For this purpose the locking ring 22, on its inner surface, is provided with notches 28 configuring an internal tool grip complementary to said first trident of assembly tool 26. Alternatively, any suitable tool which can grip with said notches 28 in the locking ring might be used. Said second trident of assembly tool 26 will be used for reconfiguring the weapon in user mode as will be described later.

Hence, by the installation of said locking ring, the cartridge case and discharge nozzle would be prevented from axial movements in a launch direction and a counter-launch direction as well. Further, in transport mode the countermass container 18 is located outside the barrel 4, for example in compartment of a transport box 30, which will be described in more detail later.

Consequently, the present invention makes it possible to prevent the shell from exiting the barrel and detonating should the propellant charge of the shell accidentally ignite. In particular during transport and storing of the weapon in compartment of said transport box 30, this is achieved by placing the weapon comprising loaded barrel 4 including the shell 6 and cartridge case assembly 10, 12 with a discharge nozzle 14, in a first compartment 32 of said transport box and the countermass container 18 outside said loaded barrel, in a second compartment 34 of said transport box. The transport box might contain compartments for several weapons and counter-mass containers, preferably four of each. The separated first 32 and second 34 compartments are such arranged, that each weapon and countermass container is snugly lodged between end walls 36 and dividing walls 38 of separate compartments of the transport box, so that the barrel 4 and countermass container are unable to move axially and radially therein. Preferably, the transport box is also provided with at least one, preferably two, third compartments 40, in which the assembly tool 26 might be lodged.

Advantageously, the counter mass container 18 being separated from the barrel 4 will create much larger expanding space in the barrel and transport box, thanks to which an increase in pressure in the barrel to such a magnitude required for exciting the shell from the barrel and activating the fuze, will be prevented.

As previously described the countermass container 18 is provided with a first locking means 20, e.g. a winding or bayonet fitting, for mounting adjacent to said discharge nozzle 14 arranged with said cartridge case assembly in the barrel 4. Further, the countermass container is already manufactured with external installation notches 42 configuring an external tool grip complementary to the second trident of assembly tool 26. Therefore, by use of a suitable assembly tool, preferably the double grip assembly tool 26 lodged in the transport box 30, the weapon can easily be reconfigured in user mode.

The invention claimed is:

1. A method of configuring a disposable preloaded weapon comprising a countermass in transport mode for restraining a shell in a barrel of said weapon, the method comprising:

configuring a weapon comprising a round receiving portion of a barrel of the weapon and a countermass receiving portion of the barrel by loading a round in the barrel, the round comprising a shell and a cartridge case assembly with a discharge nozzle, and configuring the weapon with a countermass located outside the barrel, placing the barrel in a first compartment of a transport box, placing the countermass container in a second compartment of the transport box separate from said first compartment, providing a locking ring with an internal tool grip for mounting said locking ring in the barrel with a first lock, and applying the locking ring for locking the cartridge case assembly and discharging nozzle to the barrel.

2. The method according to claim 1, further comprising:

providing the countermass container with a second lock for mounting in the barrel.

3. The method according to claim 2, further comprising:

placing, in the transport box, an assembly tool adaptable to said tool grip and appropriate for mounting.

4. The method according to claim 3, further comprising:

placing said assembly tool in a first compartment of the transport box.

5. The method according to claim 3, further comprising:

using said assembly tool for configuring the weapon in transport mode.

* * * * *